US009996029B2

(12) United States Patent
Matsumoto et al.

(10) Patent No.: US 9,996,029 B2
(45) Date of Patent: Jun. 12, 2018

(54) IMAGE FORMING APPARATUS WITH REMOVABLE RESIDUAL TONER ACCOMMODATING PORTION

(71) Applicant: CANON KABUSHIKI KAISHA, Tokyo (JP)

(72) Inventors: Risa Matsumoto, Susono (JP); Kazuki Takase, Mishima (JP); Shoichi Zensai, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/420,522

(22) Filed: Jan. 31, 2017

(65) Prior Publication Data

US 2017/0219956 A1 Aug. 3, 2017

(30) Foreign Application Priority Data

Feb. 1, 2016 (JP) ..... 2016-017195

(51) Int. Cl.
*G03G 21/10* (2006.01)
*G03G 15/08* (2006.01)
*G03G 21/12* (2006.01)

(52) U.S. Cl.
CPC ..... *G03G 15/0881* (2013.01); *G03G 15/0886* (2013.01); *G03G 21/12* (2013.01)

(58) Field of Classification Search
CPC ..... G03G 15/0881; G03G 15/0886; G03G 21/10; G03G 21/12; G03G 21/1676; G03G 21/169
USPC ..... 399/358, 360
See application file for complete search history.

(56) References Cited

U.S. PATENT DOCUMENTS 5,440,376 A 8/1995 Hagihara
2005/0175382 A1 8/2005 Kweon
2007/0297840 A1* 12/2007 Onodera ..... G03G 21/12 399/358
2008/0240779 A1* 10/2008 Ogashiwa ..... G03G 21/12 399/119

(Continued)

FOREIGN PATENT DOCUMENTS

JP 05-289505 A 11/1993
JP 11-102150 A 4/1999

(Continued)

*Primary Examiner* — Sophia S Chen
(74) *Attorney, Agent, or Firm* — Fitzpatrick, Cella, Harper & Scinto

(57) ABSTRACT

An image forming apparatus includes a main assembly; a door; a discharging portion provided in the main assembly and provided with a first opening for discharging toner; and a toner receptor detachably mounted to the door to accommodate the toner, the toner receptor being provided with a second opening cooperative with the first opening to form a toner flow passage, wherein the receptor is movable, in a state that it is mounted on the door, between a contacting position in which the receptor contacts the discharging portion such that the second opening is in fluid communication with the first opening and a spacing position in which the receptor is spaced from the discharging portion, and wherein the receptor mounted on the door is movable between the contacting and the spacing positions in a direction inclined with respect to a contact plane of the discharging portion relative to the receptor.

14 Claims, 6 Drawing Sheets

(56) References Cited

U.S. PATENT DOCUMENTS

| | | | | |
|---|---|---|---|---|
| 2014/0376963 | A1* | 12/2014 | Suzuki | G03G 15/0886 399/123 |
| 2016/0252845 | A1* | 9/2016 | Imaizumi | G03G 15/0886 399/358 |
| 2016/0349667 | A1* | 12/2016 | Imaizumi | G03G 21/1633 |

FOREIGN PATENT DOCUMENTS

| | | | |
|---|---|---|---|
| JP | 2005-156699 | A | 6/2005 |
| JP | 2005-208661 | A | 8/2005 |
| JP | 5354068 | B2 * | 11/2013 |

* cited by examiner (a)

(b)

(a)

(b)

(a)

(b)

IMAGE FORMING APPARATUS WITH REMOVABLE RESIDUAL TONER ACCOMMODATING PORTION

FIELD OF THE INVENTION AND RELATED ART

The present invention relates to an image forming apparatus which uses an electrophotographic method.

Some electrophotographic image forming apparatuses are structured so that unnecessary toner is stored in a waste toner recovery container which can be installed into, or removed from, the main assembly of an image forming apparatus. In the case of these image forming apparatuses, as the recovery container in the main assembly is filled up with waste toner, the recovery container is removed from the main assembly, and an empty recovery container is inserted into the main assembly. Also in the case of these image forming apparatuses structured as described above, there is a concern that impact might cause the waste toner in the recovery container to leak when the recovery container is removed from the main assembly. It is also concerned that a user might allow the waste toner in the recovery container to scatter, by opening the outlet (or inlet) of the container by mistake.

In recent years, demand has been increasing for smaller image forming apparatuses. Thus, it is desired to find a spatially efficient way to store a recovery container in the main assembly of an image forming apparatus. One of such spatially efficient ways is proposed in Japanese Laid-open Patent Application 2005-208661. According to this patent application, the toner transfer opening of the recovery container is provided with a shutter mechanism of the so-called slide type. More specifically, the image forming apparatus is structured so that when its recovery container is out of the main assembly of an image forming apparatus, the sliding door of the shutter mechanism keeps the toner transfer opening of the recovery container shut, and also, that it is only after the recovery container is properly installed in the main assembly that the sliding door can be opened. With the employment of this sliding shutter mechanism, it is possible to minimize spatial waste. However, the sliding shutter mechanism disclosed in Japanese Laid-open Patent Application 2005-208661 is structured so that when the sliding door is moved (slid) from a position in which the door is fully open to a position in which the door keeps the toner transfer opening sealed, the sliding door remains in contact with the sealing member positioned in a manner to surround the toner transfer opening. Further, it is structured so that when the recovery container is installed into the preset toner transfer position in the main assembly of the image forming apparatus, the sealing member fitted around the toner transfer opening of the recovery container slides on the adjacencies of the toner discharge opening of the toner discharging portion of the main assembly of the image forming apparatus. Thus, when the recovery container is installed into the main assembly of the image forming apparatus, friction occurs between the sealing member and the adjacencies of the toner discharging opening. This friction more or less interferes with the attempt to install or uninstall the recovery container. Thus, there is a concern that the friction might affect the operability of the image forming apparatus in terms of the operation to replace the recovery container. Moreover, the above described friction acts in the direction to shear the sealing member. Therefore, it is possible for the friction to damage the sealing member, or make the sealing member deteriorate, which in turn might cause the sealing member to reduce in sealing performance.

SUMMARY OF THE INVENTION

According to an aspect of the present invention, there is provided an image forming apparatus for forming an image on a recording material using toner, said image forming apparatus comprising a main assembly; an openable member capable of opening and closing said main assembly; a discharging portion provided in said main assembly and provided with a first opening for discharging toner; and a toner accommodating portion detachably mounted to said openable member and configured to accommodate the toner, said toner accommodating portion being provided with a second opening cooperative with said first opening to form a toner flow passage, wherein said toner accommodating portion is movable, in a state that it is mounted on said openable member, between a contacting position in which said toner accommodating portion contacts said discharging portion such that said second opening is in fluid communication with said first opening and a spacing position in which said toner accommodating portion is spaced from said discharging portion, and wherein said toner accommodating portion mounted on said openable member is movable between the contacting position and the spacing position in a direction inclined with respect to a contact plane of said discharging portion relative to said toner accommodating portion.

Further features of the present invention will become apparent from the following description of exemplary embodiments with reference to the attached drawings.

Figure 1:
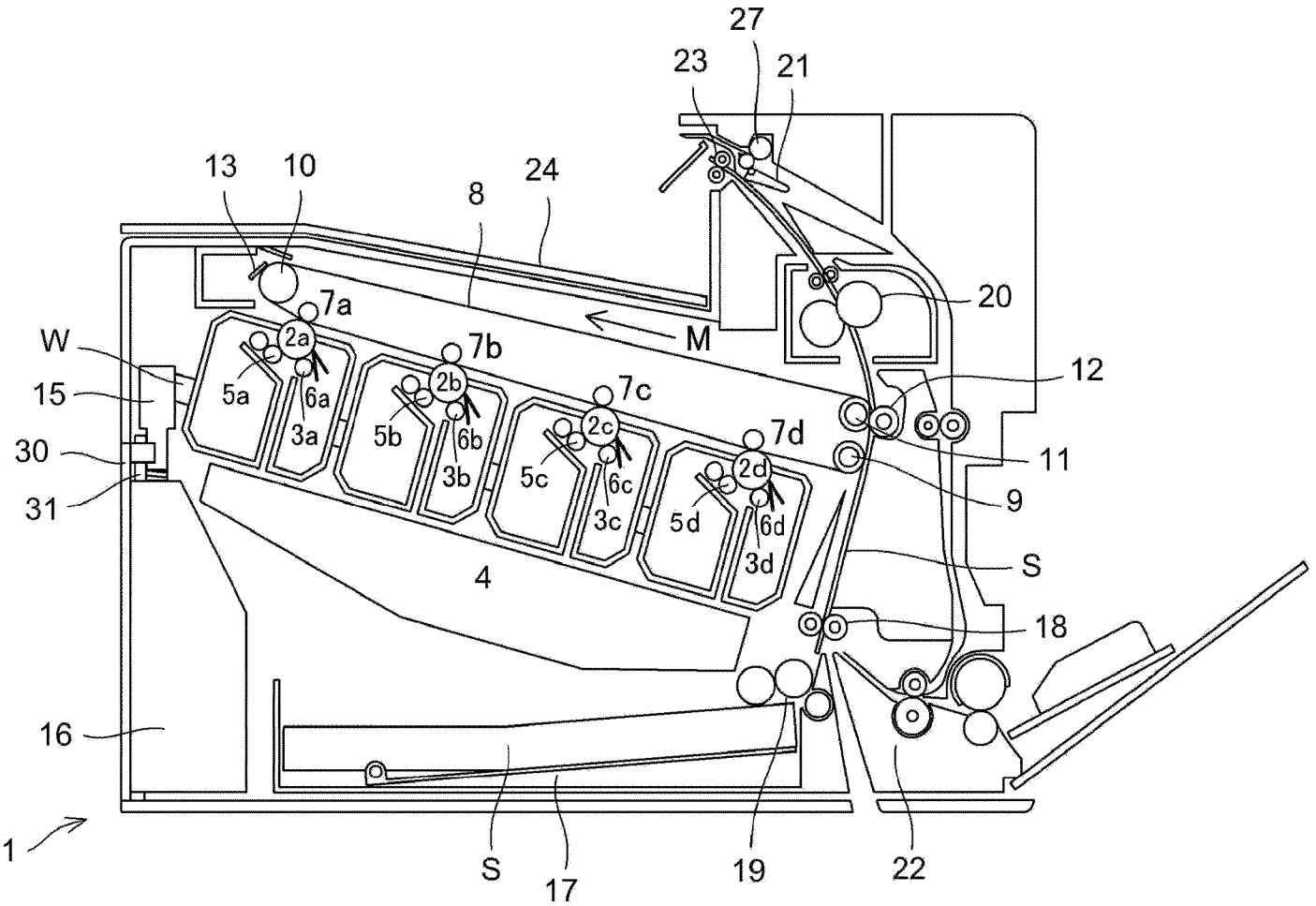
FIG. 1 is a schematic sectional view of the image forming apparatus in one of the preferred embodiments of the present invention.
Figure 2:
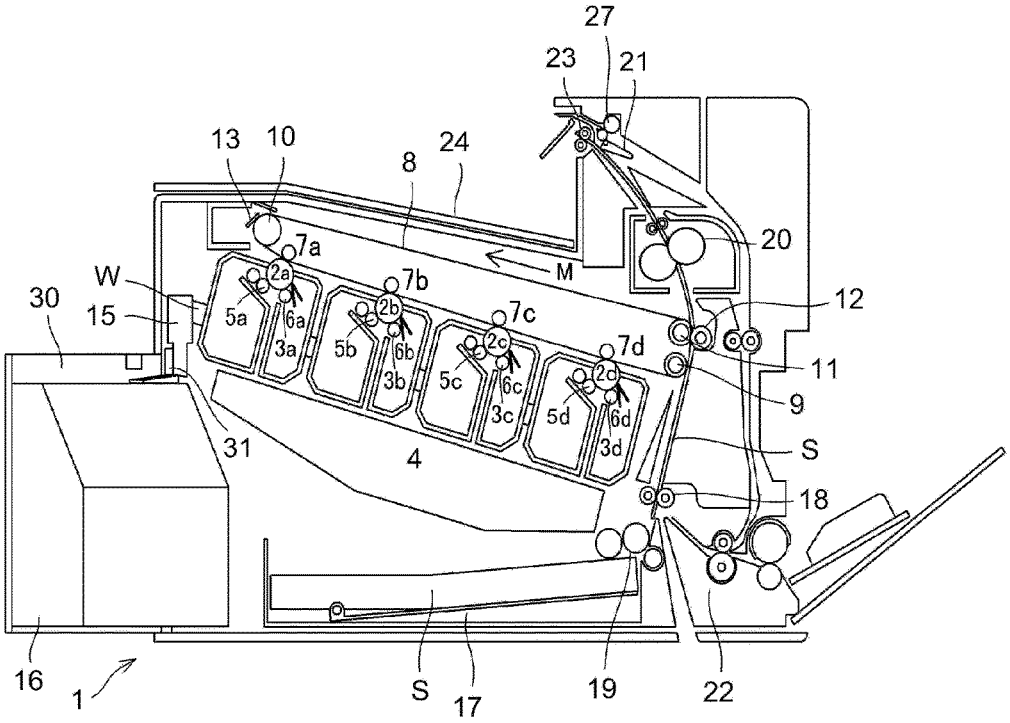
Figure 2:
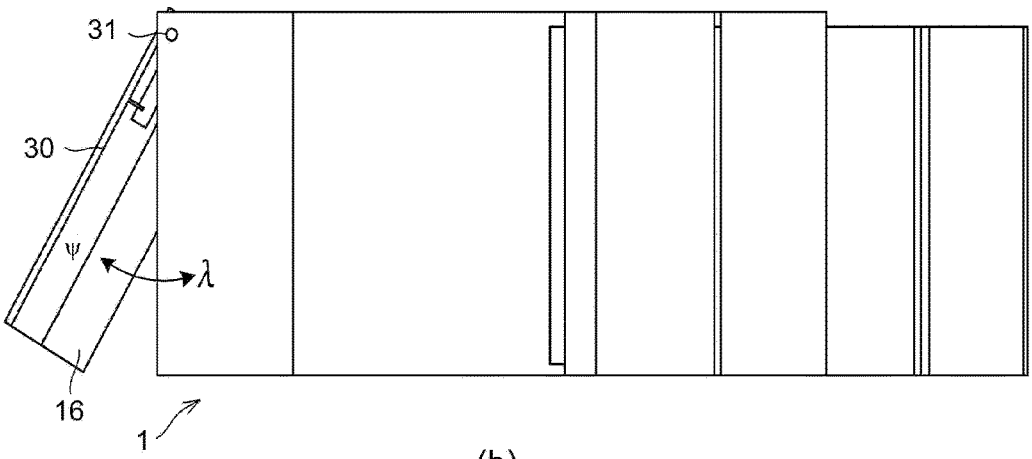

Parts (a) and (b) of FIG. 2 are a schematic sectional view of the image forming apparatus shown in FIG. 1, and a top plan view of the image forming apparatus of FIG. 1.

Figure 3:
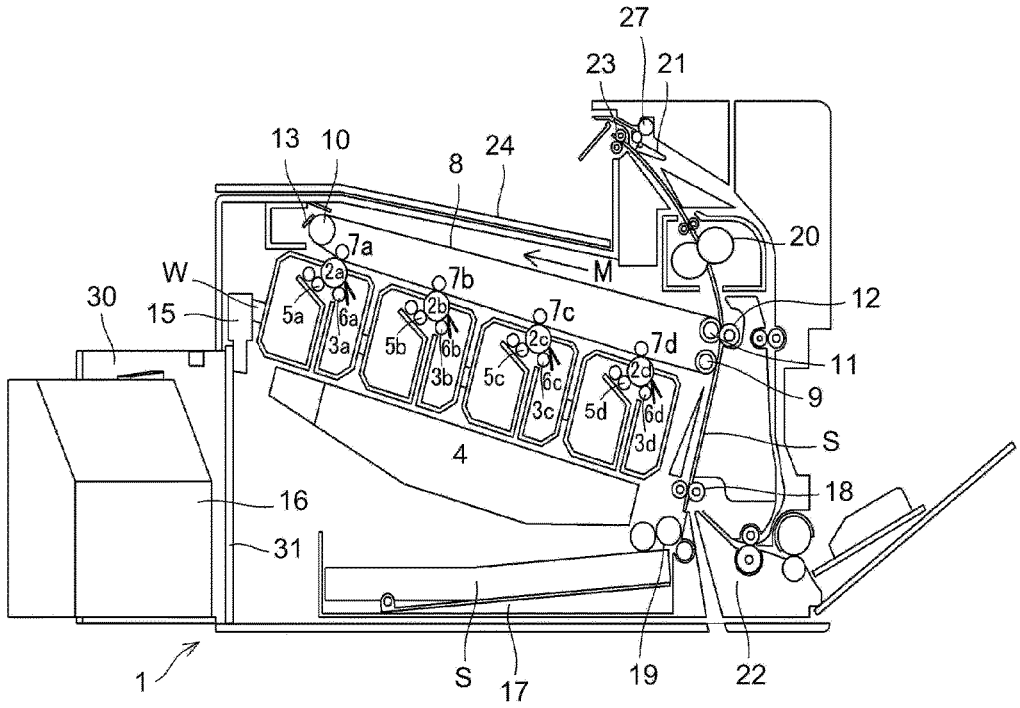
Figure 3:
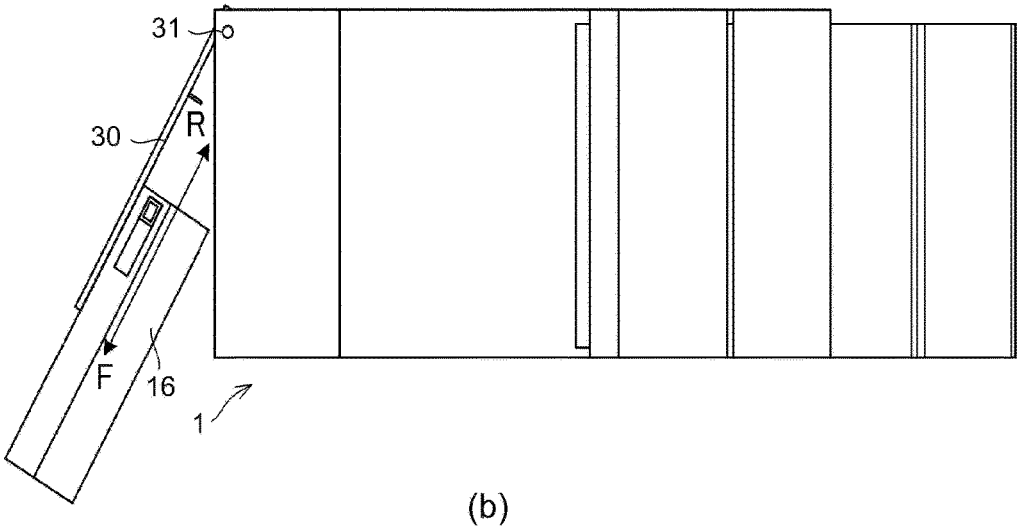

Parts (a) and (b) of FIG. 3 are a schematic sectional view of the image forming apparatus shown in FIG. 1, and a top plan view of the image forming apparatus shown in FIG. 1.

Figure 4:
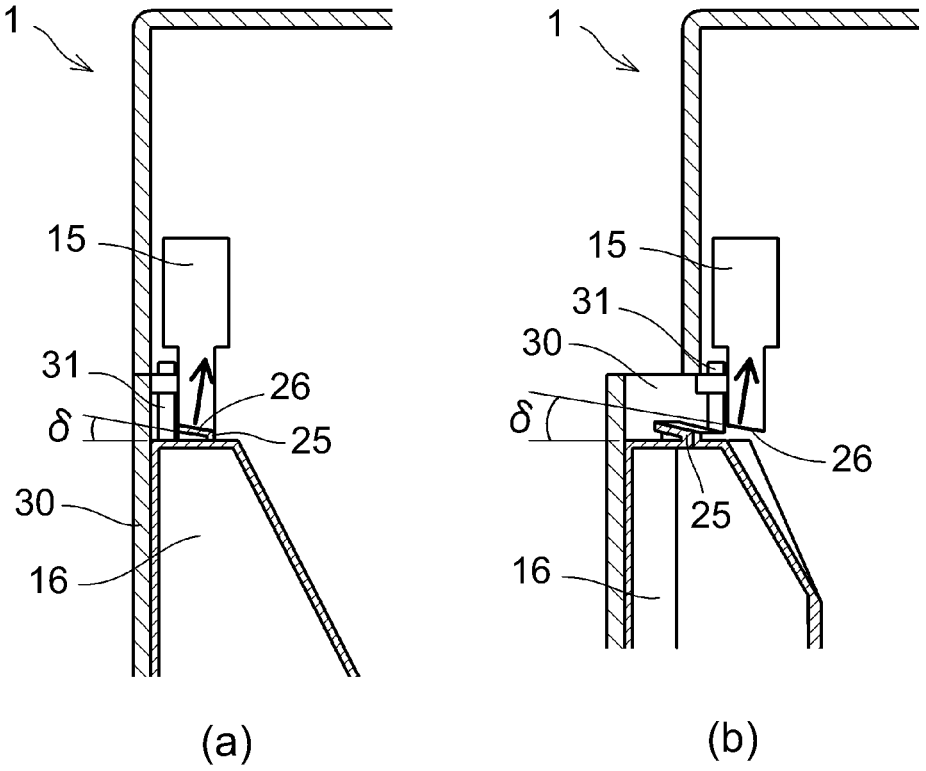

Parts (a) and (b) of FIG. 4 are schematic views illustrating the mechanism for separating the toner discharging portion and the toner receiving portion from each other.

Figure 5:
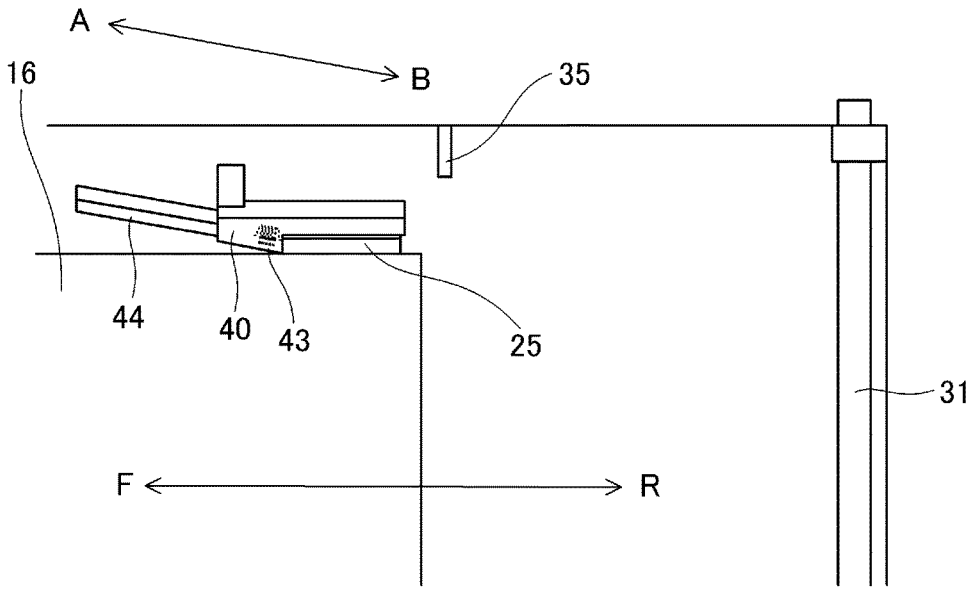
Figure 5:
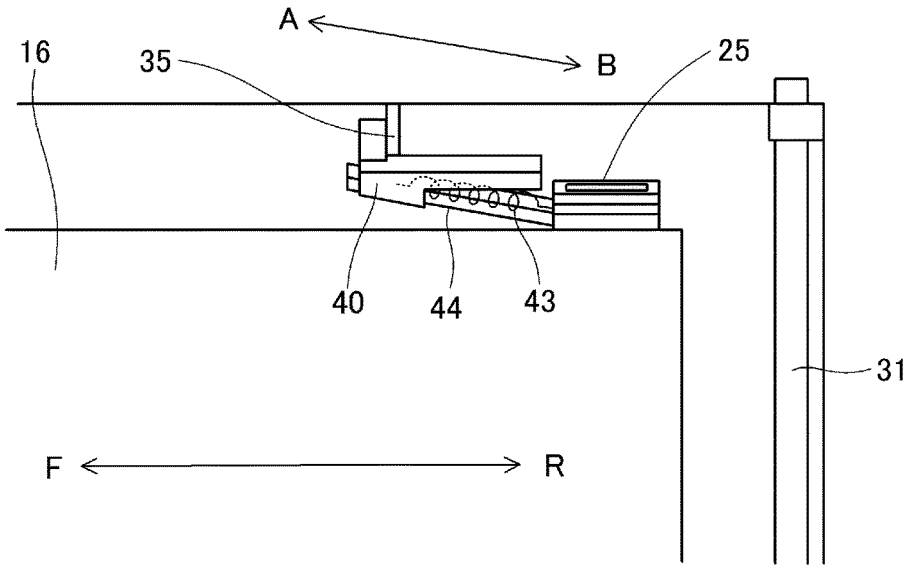

Parts (a) and (b) of FIG. 5 are schematic views illustrating the mechanism for separating the toner discharging portion and the toner receiving portion from each other.

Figure 6:
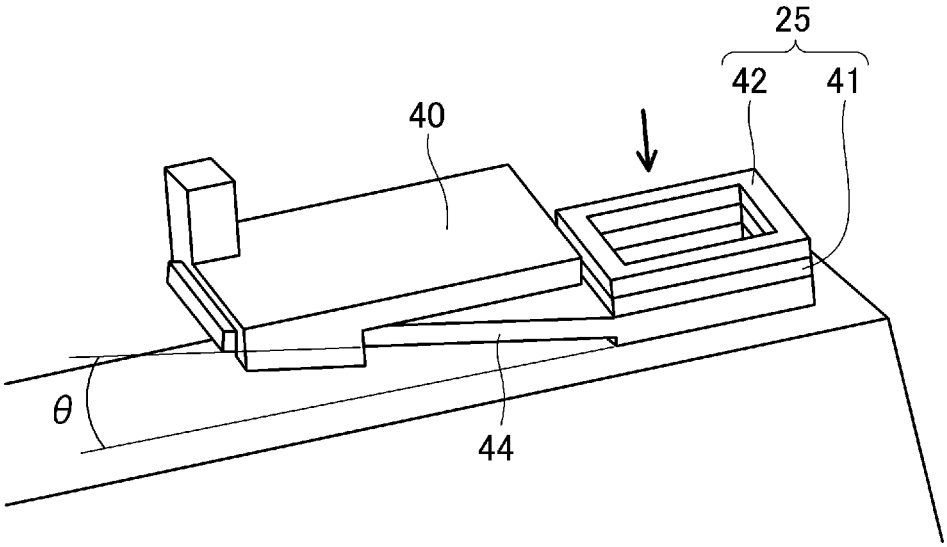

FIG. 6 is a schematic drawing for describing the structure of the toner reception opening of the toner container, and that of the opening-closing member.

DESCRIPTION OF THE EMBODIMENTS

Hereinafter, the present invention is described in detail with reference to one of preferred embodiments of the present invention. However, the measurement, materials, and shapes of the structural components of the image forming apparatuses in the following embodiment of the present invention, and the positional relationship among the components, are to be altered according to the structure of an apparatus to which the present invention is applied, and/or the condition under which the apparatus is operated. That is, the following embodiment of the present invention is not intended to limit the present invention in scope.

Embodiment

FIG. 1 is a schematic sectional view of the image forming apparatus in this embodiment of the present invention. It shows the overall structure of the apparatus. The image forming apparatus in this embodiment is one of the image forming apparatuses to which the present invention is applicable. It is a color laser beam printer of the so-called tandem type (having four photosensitive drums which are sequentially disposed in parallel). It is also of the so-called intermediary transfer type. It is capable of forming a full-color image on recording medium, with the use of an electrophotographic method.

<Structure of Image Forming Apparatus>

The image forming apparatus 1 in this embodiment has four electrophotographic photosensitive members, that is, photosensitive drums 2 (2*a*, 2*b*, 2*c* and 2*d*), as image bearing members, which are sequentially disposed in parallel in the direction which is angled relative to the horizontal direction. Each photosensitive drum 2 is rotationally driven in the clockwise direction in FIG. 1 by an unshown driving unit. The peripheral surface of the photosensitive drum 2 is uniformly charged by a charging device 3 (3*a*, 3*b*, 3*c* or 3*d*). The uniformly charged portion of the peripheral surface of the photosensitive drum 2 is scanned by a beam of laser light outputted by a scanner unit 4 while being modulated according to the information of the image to be formed. Consequently, an electrostatic latent image (electrostatic image) is effected on the peripheral surface of the photosensitive drum 2. This electrostatic latent image is developed as a toner image by a developing device 5 (5*a*, 5*b*, 5*c* or 5*d*); toner is adhered to the electrostatic latent image by the developing device 5. The transfer residual toner, that is, the toner which remains on the peripheral surface of the photosensitive drum 2 after the transfer of the toner image onto an intermediary transfer belt 8, is removed by a drum cleaning device 6 (6*a*, 6*b*, 6*c* or 6*d*). As a process cartridge is filled up with the removed transfer residual toner, and therefore, it becomes impossible for the process cartridge to accept additional transfer residual toner, the additional (excessive) transfer residual toner is conveyed to a toner discharge duct by a toner conveyance mechanism W. Then, it is recovered into a toner recovery container 16 through the toner discharge duct 15. The toner discharge duct 15 in this embodiment is equivalent to a combination of the discharging portion and transfer portion in the present invention, whereas the toner recovery container in this embodiment is equivalent to a combination of the receiving portion, toner container, and toner storing portion in the present invention.

The image forming apparatus 1 in this embodiment uses cartridge units, each of which comprises the photosensitive drum 2, charging device 3, developing device 5, and cleaning device 6, which are integrally disposed in the cartridge unit. That is, the image forming apparatus 1 in this embodiment is equipped with four cartridge units, which form four images, one for one, which are different in color (yellow, magenta, cyan and black), with the use of an electrophotographic recording method.

The primary transfer roller 7 (7*a*, 7*b*, 7*c* or 7*d*), which belongs to a transfer unit, is in contact with the intermediary transfer belt 8 which is in contact with the photosensitive drum 2. As transfer bias is applied to the primary transfer roller 7, the toner image on the photosensitive drum 2 is transferred onto the intermediary transfer belt 8 by the transfer bias. The intermediary transfer belt 8 is suspended and tensioned by a combination of a driving roller 9, a tension roller 10, and a belt-backing roller 11 (which opposes a secondary transfer roller 12) in a manner to bridge between the adjacent two rollers. It is rotationally driven by the driving roller 9 in the counterclockwise direction M. As bias is applied to the secondary transfer roller 12 which is disposed in a manner to oppose the belt-backing roller 11 with the presence of the intermediary transfer belt 8 between itself and the belt-backing roller 11, the secondary transfer roller 12 transfers the toner image on the intermediary transfer belt 8 onto a sheet S of recording medium. The transfer residual toner, or the toner which failed to be transferred onto the sheet S, and therefore remains on the intermediary transfer belt 8, is removed and recovered by a cleaning blade 13, which is disposed as a belt cleaning device means, in a manner to oppose the tension roller 10, with the presence of the intermediary transfer belt 8 between itself and the tension roller 10.

The image forming apparatus 1 is provided with a unit for feeding a sheet S of recording medium into the main assembly of the image forming apparatus 1, and then, conveying the sheet S further into the apparatus main assembly. This sheet feeding-conveying unit is disposed in the bottom portion of the main assembly. It has a pickup roller 19 for feeding the sheets S of recording medium one by one into the main assembly, and a pair of registration rollers 18 for correcting each sheet S in attitude. The sheets S in a sheet feeder cassette 17 are moved out of the cassette, one by one, and each sheet S is conveyed to the secondary transferring portion, which is the area of contact between the intermediary transfer belt 8 and secondary transfer roller 12. The toner image (full-color toner image formed on sheet S, of monochromatic toner images which are different in color, through the process of layering four toner images, on intermediary transfer belt 8) is transferred onto the sheet S in the secondary transferring portion. After the transfer of the toner image from the intermediary transfer belt 8 onto the sheet S, the sheet S is heated and pressed by a fixing means 20 which is disposed on the downstream side of the secondary transferring portion. Consequently, the toner image is fixed to the sheet S. This is how a color image is formed on a sheet S of recording medium.

In an image forming operation for forming an image on only one surface of each sheet S of recording medium, after the fixation of the toner image to the sheet S, the sheet S is guided to a discharge passage by a flapper 21, and then is discharged into a delivery tray 24 (as a sheet stacking unit) by a pair of discharge rollers 23. In an image forming operation for forming an image on both surfaces of a sheet S of recording medium, the flapper 21 is switched in position, and the roller 27 begins to be rotated in reverse with such timing that the trailing end portion of the sheet S having an image (first image) on only one of its two surfaces reaches the roller 27. Thus, as the sheet S reaches the roller 27, the sheet S begins to be conveyed back into the main assembly of the image forming apparatus 1 from the discharge tray side of the main assembly (apparatus 1 is changed in recording medium conveyance direction so that sheet S is conveyed in opposite direction from normal direction). As the sheet S is conveyed back into the main assembly by the reversal rotation of the roller 27, it is introduced into a sheet passage 22 for two-sided image formation. Then, it is conveyed through the sheet passage 22 for two-sided image formation mode, and then is conveyed back into the secondary transferring portion with a preset timing, while remaining upside-down. Consequently, a toner image is transferred onto the second surface (back surface) of the sheet S.

<Toner Recovery System>

Next, referring to FIGS. 1-3, the method for replacing the toner recovery container 16 (which hereafter will be referred to simply as "container 16"), and the structure of the left door 30, are described. The left door 30 is such a member of the image forming apparatus 1 that is structured so that it can be opened to expose the interior of the main assembly of the image forming apparatus 1 to enable a user to replace the container 16. The container 16 is provided with a sealing member 40 (FIG. 5) for keeping sealed the toner reception opening 25 (which hereafter will be referred to simply as "reception opening 25"), which is the second opening. The sealing member 40 is under the pressure applied thereto by a tension spring 43 (coil spring) as a pressure applying member, in the direction to keep the sealing member 40 airtightly in contact with the adjacencies of the reception opening 25. That is, the container 16 and left door 30 are structured so that when the sealing member 40 is not under external force or the like, the reception opening 25 remains sealed by the sealing member 40.

When the image forming apparatus 1 is in the state shown in FIG. 1, the left door 30 is closed, and the image forming apparatus 1 can carry out an image forming operation. More specifically, when the image forming apparatus 1 is in the state shown in FIG. 1, the left door 30 is in a position in which it remains closed; the container 16 is in its first position in which it remains after the proper installation of the container 16 into the left door 30, and also, is in the second position in the apparatus main assembly, in which it remains after the closing of the left door 30. In an image forming operation, the toner remaining on the peripheral surface of the photosensitive drum 2 after the primary transfer is scraped away by the cleaning blade 6, and falls. Then, the toner is conveyed leftward of the apparatus main assembly by a toner conveyance system W, which is on the drum side of the container 16, is conveyed to the container 16 by way of the toner discharge duct 15, and then, accumulates in the container 16. In order to ensure that the removed toner falls into the container 16, the toner discharge duct 15 is disposed above the container 16. If an unshown sensor determines that the container 16 is full, the apparatus main assembly issues to a user a signal for informing the user that the container 16 needs to be replaced (it displays sign on display panel, turns on lamp, or takes the like action).

FIG. 2 is a schematic drawing of the image forming apparatus 1 when the left door 30 is open. More specifically, part (a) of FIG. 2 is a sectional view of the apparatus 1 at a plane which is parallel to the front surface of the apparatus 1. Part (b) of FIG. 2 is a top view of the apparatus 1. As a user rotates the left door 30 in the direction indicated by an arrow mark ψ in part (b) of FIG. 2 about the rotational axis 31 of the left door 30 to open the left door 30, the state of the image forming apparatus 1 changes from the one shown in FIG. 1 to the one shown in FIG. 2. In FIG. 2, the left door 30 is in the position in which it is open, and the container 16 is in the first position in which it is properly disposed relative to the left door 30, but it is not in its second position in the apparatus main assembly (first state in which container 16 is right after opening the left door 30, and prior to the closing of the left door 30).

FIG. 3 is a schematic drawing of the image forming apparatus 1 when the left door 30 is fully open and the container 16 is being moved. More specifically, part (a) of FIG. 3 is a sectional view of the image forming apparatus 1 at a plane which is parallel to the front surface of the image forming apparatus 1, and part (b) of FIG. 3 is the top view of the image forming apparatus 1. If a user wants to take the container 16 out of the apparatus main assembly, the user is to fully open the left door 30, and slide the container 16 out of the apparatus main assembly in the direction indicated by an arrow mark F in part (b) of FIG. 3 along the left door 30. If the user wants to install the container 16 into the main assembly, the user is to install the container 16 into the left door 30 by sliding the container 16 along the left door 30 in the direction indicated by the direction indicated by an arrow mark R in FIG. 3, and rotate the left door 30 in the direction indicated by an arrow mark λ in FIG. 2 to close the left door 30, in order to put the image forming apparatus 1 in the state shown in FIG. 1. That is, when the image forming apparatus 1 is in the state shown in FIG. 3, the left door 30 is open, and the container 16 is not in the first position, that is, the position in which the container 16 will be after the proper installation of the container 16 into the left door 30, nor in the second position, that is, the position in which the container 16 will be after the completion of the installation of the container 16 in the apparatus main assembly (state in which container 16 is about to be installed into apparatus main assembly).

<Structure of Toner Transfer Opening>

Next, referring to FIGS. 4-6, the structure of toner transfer opening, which is the most characteristic aspect of the present invention, is described.

FIG. 4 is a schematic drawing of a combination of the container 16, toner discharge duct 15, and their adjacencies. It is for showing how the container 16 and toner discharge duct 15 come into contact with, or become separated from, each other. Part (a) of FIG. 4 shows the combination when the left door 30 remains closed, and part (b) of FIG. 4 shows the combination when the left door 30 is open. Parts (a) and (b) of FIG. 4 correspond to FIGS. 1 and 2, respectively. Referring to part (a) of FIG. 4, when the left door 30 remains closed, the adjacencies of the toner transfer opening of the toner discharge duct 15, that is, the adjacencies of the reception opening of the container 16, and the toner discharge opening 26 (which hereafter will be referred to simply as "discharge opening 26") are parallel to each other, and remain airtightly in contact with each other. More concretely, the top surface of the seating member 42 is formed in a manner to surround the reception opening 25 as the second opening remains in contact with the adjacencies of the discharge opening 26. Details of this contact will be given later. When the container 16 and toner discharge duct 15 are positioned relative to each other (reception position, contacting position) as shown in part (a) of FIG. 4, the container 16 and toner discharge duct 15 are in contact with each other in such a manner that the reception opening 25 is in connection with the discharge opening 26, and the toner passage remains sealed.

By the way, in the present invention, any position in which the container 16 is when the container 16 is not in the above described reception position (position of container 16 relative to toner discharge duct 15), that is, the position of the container 16 and toner discharge duct 15 relative to each other, in which toner passage is incompletely sealed, will be referred to as no-reception position, or separation position.

The arrow marks in FIG. 4 indicate the direction which is perpendicular to the adjacencies of the reception opening 25 and those of the discharge opening 26 (direction perpendicular to area of contact between two adjacencies). The direction perpendicular to the adjacencies of the reception opening 25 and those of the discharge opening 26 have an angle δ relative to a plane which is perpendicular to the rotational axis 31 of the left door 30. That is, as the left door 30 is opened or closed, the container 16 is rotationally moved about the rotational axis 31, whereby the container 16 is made to come into contact, or separate from, the toner discharge duct 15. Further, the direction which is perpendicular to the abovementioned area of contact is angled relative to the center of the rotational movement (rotational axis 31) of the container 16 (left door 30). Therefore, the direction in which the container 16 is moved relative to the toner discharge duct 15 by the opening or closing (rotation) of the left door 30 is angled relative to the area of contact between the adjacencies of the reception opening 25 and those of the discharge opening 26. That is, it is neither parallel to the plane of contact nor perpendicular to the plane of contact. Therefore, it is only as the container 16 is moved into its reception position that the container 16 comes into contact with the toner discharge duct 15. Further, as the container 16 is moved into the reception position, not only do the adjacencies of the reception opening 25 of the container 16 come into contact with the adjacencies of the discharge opening 26 of the toner discharge duct 15, but also the former becomes parallel to the latter. That is, unless the former is not in its reception position, they are not parallel. Therefore, the image forming apparatus 1 in this embodiment, which is structured as described above, is significantly smaller in the amount of the friction which occurs when the reception opening 25 is separated from the discharge opening 26 than any conventional image forming apparatus which is not structured like the one in this embodiment. That is, the present invention can significantly reduce an image forming apparatus in the amount of the friction which occurs as the container 16 (reception opening 25) is moved away from the toner discharge duct 15 (discharge opening 26).

For example, if an image forming apparatus is structured so that the container 16 slides in the direction which is parallel to the area of contact between the container 16 and toner discharge duct 15 (line about which container 16 is rotationally moved is parallel to direction which is perpendicular to area of contact), as the left door 30 is closed, the container 16 continuously rubs the toner discharge duct 15 until the container 16 is moved into its reception position. Further, when the container 16 is moved away from its reception position (separated from the toner discharge duct 15) by the opening of the left door 30, the container 16 rubs the toner discharge duct 15 for a while after it begins to be separated from the toner discharge duct 15. That is, even if the container 16 is in no-reception position, the container 16 continuously rubs the toner discharge duct 15 while the left door 30 is opened. In comparison, in this embodiment, it is only when the container 16 is in its reception position that the container 16 is in contact with the toner discharge duct 15 as described above; when the container 16 is not in its reception position, it is not in contact with the toner discharge duct 15, and therefore, the container 16 does not rub the toner discharge duct 15. That is, the present invention can improve an image forming apparatus in the operability related to the mounting and dismounting of its container 16, without reducing airtightness between the container 16 and the adjacencies of the transfer opening of the toner discharge duct 15.

FIG. 5 is a schematic drawing for showing the structure of a combination of the container 16 and left door 30. More specifically, parts (a) and (b) of FIG. 5 show the combination when the reception opening 25 of the container 16 remains sealed and unsealed, respectively, by the sealing member 40. They correspond to FIGS. 2 and 3, respectively. The directions indicated by arrow marks F and R in FIG. 5 are the same as those in FIG. 3. The sealing member 40 is attached to the top surface of the container 16 in such a manner that it is allowed to slide on a guiding portion 44, which is attached to the container 16 in such a manner that it extends from the edge of the reception opening 25 at a preset upward angle away from the reception opening 25. The sealing member 40 is kept under the pressure generated by the tension spring 43 in the direction to keep the reception opening 25 closed. It can be moved in the direction to expose the reception opening 25 by the application of external force to the sealing member 40. The arrow marks A and B indicate the directions in which the sealing member 40 can be moved relative to the container 16. The movement of the sealing member 40 between its open and closed position is linear. During the installation of the container 16 into the left door 30, the container 16 is made to move between a position in which it keeps the reception opening 25 closed, and a position in which it keeps the reception opening 25 exposed, by being made to engage with a protrusion 35 (engaging portion).

By the way, in this specification of the present invention, any position in which the sealing member 40 is not in the above described position in which it keeps the container 16 closed (position of sealing member 40 relative to container 16), that is, the position of the sealing member 40 relative to the container 16, in which the sealing member 40 does not keep the reception opening completely covered, is referred to as an open position.

Part (a) of FIG. 5 shows the state of the combination of the sealing member 40, left door 30, and container 16, in which the container 16 has not been inserted deep enough into the left door 30 in the direction R for the sealing member 40 to come into contact with the protrusion 35, and therefore, the reception opening 25 remains sealed by the sealing member 40. Part (b) of FIG. 5 shows the combination in which the container 16 has been completely inserted into the left door 30, and the reception opening 25 is exposed since the reception opening 25 was moved away from a position in which it remains sealed by the sealing member 40, by the contact between the sealing member 40 and protrusion 35. While the state of the combination changes from the one shown in part (a) of FIG. 5 to the one shown in part (b) of FIG. 5, that is, as the container 16 is inserted into the left door 30 in the direction R, the sealing member 40 is caught by the protrusion 35. Thus, as the container 16 is inserted further into the left door 30, the reception opening 25 is moved from the area in which it remains sealed by the sealing member 40 to a position in which it is not sealed by the sealing member 40.

FIG. 6 is an enlarged schematic perspective view of the reception opening 25 of the toner recovery container 16 and its adjacencies. The adjacencies of the reception opening 25 are covered with a seating member 42, which is adhered to the adjacencies of the reception opening 25 with the use of an adhesive member 41, which is an elastic member formed of a rubbery substance such as rubber, sponge, etc. It is adhered to the adjacencies of the reception opening 25 in a manner to surround the reception opening 25; it extends along the edge of the reception opening 25. The seating member 42 is formed of a PET sheet or the like. It is layered (stacked) on the adhesive member 41 in a manner to surround the reception opening 25 like the adhesive member 41. Not only is the top surface of the seating member 42 such a surface that comes into contact with the sealing member 40 when the reception opening 25 is sealed with the sealing member 40, but also such a surface that remains in contact with the adjacencies of the sealing member 40 as the sealing member 40 seals the reception opening 25. The sealing member 40 and toner discharge duct 15 are formed of a resinous substance. By the way, the surface of the adjacencies of the discharge opening 26 of the toner discharge duct 15, which comes into contact with the top surface of the seating member 42, is the surface area of the toner discharge duct 15, which comes into contact with the toner reception portion of the toner discharging portion in this embodiment of the present invention.

When the reception opening 25 remains sealed by the sealing member 40, the adhesive member 41 and seating member 42 remain sandwiched between the sealing member 40 and the adjacencies of the reception opening 25 of the container 16. The seating member 42 is airtightly placed in contact with the sealing member 40 by a combination of the resiliency of the tension spring 43, which acts on the sealing member 40, and the force generated in the adhesive member 41 as the adhesive member 41 is compressed between the sealing member 40 and container 16. Therefore, the toner in the container 16 is prevented from leaking from the container 16.

Similarly, even after the reception opening 25 is connected to the discharge opening 26 by the closing of the left door 30, the adhesive member 41 and seating member 42 remain sandwiched between the adjacencies of the reception opening 25 of the container 16 and the adjacencies of the discharge opening 26. Thus, the area of contact between the adjacencies of the discharge opening 26 and the seating member 42 is improved in airtightness by the force generated in the adhesive member 41, because the adhesive member 41 remains compressed between the adjacencies of the reception opening 25 and the adjacencies of the discharge opening 26. Therefore, toner is prevented from leaking from the toner transfer passage which connects the toner discharge duct 15 and container 16.

The top surface of the seating member 42 has an angle θ relative to the directions A and B in which the sealing member 40 is slid into, or out of, the left door 30. The arrow mark in FIG. 6 indicates the direction in which adhesive member 41 is compressed. The sealing member 40 does not come into contact with the top surface of the seating member 42 until it is moved into a position in which it is to keep the reception opening 25 sealed. This structural setup is similar to the above described structural setup for causing the reception opening 25 and discharge opening 26 to come into contact with, or be separated from, each other. Adoption of this structural arrangement for causing the sealing member 40 to contact, or separate from, the reception opening 25 (of container 16) can reduce the amount of friction which is generated between the sealing member 40 and the adjacencies of the reception opening 25 by the movement of the sealing member 40, and also can enable the sealing member 40 to more smoothly move, compared to the structural arrangement which does not provide the aforementioned angle, for example, a structural arrangement which causes the sealing member 40 to slide on the top surface of the sealing member 40 in parallel to the top surface. Further, this embodiment can reduce the friction between the sealing member 40 and the seating member 42 and the friction between the sealing member 40 and the adjacencies of the discharge opening 26 of the toner discharge duct 15, compared to any conventional structural arrangement. Therefore, it is possible to significantly reduce problems such as the seating member 42 and/or adhesive member 41 are peeled away from the container 16, are damaged, and/or are deteriorated. Therefore, it is ensured that the abovementioned areas of contact between the container 16 and apparatus main assembly remain satisfactorily sealed for a long time.

As described above, by slanting the reception opening 25 and discharge opening 26 relative to the direction in which the container 16 is made to move when the container 16 is installed into, or uninstalled from, the main assembly of an image forming apparatus, it is possible to reduce the friction which occurs between the container 16 and the components of the toner discharging system, relative to which the container 16 is moved when it is installed or uninstalled, and therefore, it is possible to keep the toner transfer passage satisfactorily sealed for a long time. Further, not only can it simplify in structure the toner transferring portion of an image forming apparatus, which includes the toner discharging portion 15 and container 16, but also can reduce the portion in size. Therefore, it is possible to make it easier to install or uninstall the container 16, without reducing the container 16 in size.

In this embodiment, the direction (indicated by arrow marks F and R in FIGS. 3 and 5) in which the toner recovery container is moved when it is installed or uninstalled, is parallel to the surface on which the image forming apparatus is placed. However, the direction is not limited to the one in this embodiment. For example, it may be such direction that includes the direction which is perpendicular to the surface on which the image forming apparatus is placed. Further, the direction (directions indicated by arrow marks A and B in FIG. 5) in which the opening-closing member moves may be parallel to the direction (directions indicated by arrow marks F and R in FIGS. 3 and 5) in which the recovery container moves.

In this embodiment, the present invention was applied to the toner recovery system. However, this embodiment is not intended to limit the present invention in scope. For example, the present invention is also applicable to a toner supplying system, which is opposite in function from the toner recovery system. More concretely, the present invention is applicable to an image forming apparatus structured to maintain a seal between the toner outlet of the toner supply bottle for replenishing an image forming apparatus (developing device) with toner, and the toner reception opening of the toner storing portion of the apparatus main assembly. That is, in this case, it is to the toner discharging portion, instead of the toner receiving portion, of a toner container which is removably attached to the main assembly of an image forming apparatus that the present invention is applied.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-017195 filed on Feb. 1, 2016, which is hereby incorporated by reference herein in its entirety.

What is claimed is:

1. An image forming apparatus for forming an image on a recording material using toner, said image forming apparatus comprising:

a main assembly;

an openable member capable of opening and closing said main assembly;

a discharging portion provided in said main assembly and provided with a first opening for discharging toner, a direction perpendicular to the first opening being inclined with respect to a plane which is perpendicular to a rotational axis of said openable member; and a toner accommodating portion detachably mounted to said openable member and configured to accommodate the toner, said toner accommodating portion being provided with a second opening cooperative with said first opening to form a toner flow passage, wherein said toner accommodating portion includes an elastic member extending along a periphery of said second opening so as to surround said second opening, and a sheet member overlaid on said elastic member so as to surround said second opening, wherein said toner accommodating portion is movable, in a state that it is mounted on said openable member, between a contacting position in which said toner accommodating portion contacts said first opening and a spacing position in which said toner accommodating portion is spaced from said discharging portion, and wherein said sheet member contacts said first opening when said toner accommodating portion is in the contacting portion.

2. An apparatus according to claim 1, wherein a moving direction of said toner accommodating portion between the contacting position and the spacing position is different from a direction in which a contact plane of said discharging portion relative to said toner accommodating portion extends and from a direction perpendicular to the contact plane.

3. An apparatus according to claim 2, wherein said toner accommodating portion is rotatable relative to said discharging portion between the contacting position and the spacing position, and a normal line of the contact plane of said discharging portion relative to said toner accommodating portion is not parallel with the rotational axis of said openable member.

4. An apparatus according to claim 3, wherein a normal line of a contact plane of said toner accommodating portion relative to said discharging portion is parallel with the normal line of said discharging portion relative to said toner accommodating portion, when said toner accommodating portion is in the contacting position.

5. An apparatus according to claim 1, wherein said toner accommodating portion mounted on said openable member is movable between the contacting position and the spacing position in a direction inclined with respect to a contact plane of said discharging portion relative to said toner accommodating portion.

6. An apparatus according to claim 1, wherein the contact plane of said toner accommodating portion is that of a top surface of said sheet member.

7. An apparatus according to claim 1, wherein said toner accommodating portion accommodates residual toner discharged from said main assembly.

8. An apparatus according to claim 7, wherein said toner accommodating portion is rotatable between the contacting position and the spacing position about the rotational axis of said openable member in the state that said toner accommodating portion is mounted on said openable member.

9. An apparatus according to claim 8, wherein a contact plane of said toner accommodating portion relative to said discharging portion and a contact plane of said discharging portion relative to said toner accommodating portion are inclined relative to the plane perpendicular to the rotational axis.

10. An apparatus according to claim 1, wherein said second opening and said first opening are in parallel with each other when in the contacting position, and are non-parallel relative to each other when in the spacing position.

11. An image forming apparatus for forming an image on a recording material using toner, said image forming apparatus comprising:

a main assembly;

an openable member capable of opening and closing said main assembly;

a discharging portion provided in said main assembly and provided with a first opening for discharging toner; and a toner accommodating portion detachably mounted to said openable member and configured to accommodate the toner, said toner accommodating portion being provided with a second opening cooperative with said first opening to form a toner flow passage, wherein said toner accommodating portion is in a contacting position in which said toner accommodating portion contacts said discharging portion such that said second opening is in fluid communication with said first opening, in a state that said toner accommodating portion is mounted on said openable member and said openable member is closed, and wherein said toner accommodating portion is movable, in a state that said toner accommodating portion is mounted on said openable member and said openable member is open, between the contacting position in which said toner accommodating portion contacts said discharging portion and a spacing position in which said toner accommodating portion is spaced from said discharging portion.

12. An apparatus according to claim 11, further comprising:

an engaging portion provided with said main assembly, and a sealing member provided with said toner accommodating portion to seal said second opening, wherein said second opening is exposed by contact between said sealing member and said engaging portion.

13. An apparatus according to claim 12, wherein said engaging portion is provided with said main assembly in a position where said engaging portion comes into contact with said sealing member between the contacting position and the spacing position.

14. An apparatus according to claim 12, wherein a direction perpendicular to said second opening is inclined with respect to a plane which is perpendicular to a rotational axis of said openable member.

* * * * *